US007341094B2

(12) United States Patent
Manda

(10) Patent No.: US 7,341,094 B2
(45) Date of Patent: Mar. 11, 2008

(54) METALLIC ALLOY SLURRY DISPENSER

(75) Inventor: Jan Marius Manda, Toronto (CA)

(73) Assignee: Husky Injection Molding Systems Ltd., Bolton, Ontario (CA)

( * ) Notice: Subject to any disclaimer, the term of this patent is extended or adjusted under 35 U.S.C. 154(b) by 260 days.

(21) Appl. No.: 11/120,223

(22) Filed: May 2, 2005

(65) Prior Publication Data

US 2006/0243416 A1 Nov. 2, 2006

(51) Int. Cl.
*B22D 17/04* (2006.01)

(52) U.S. Cl. ..... 164/312; 164/337; 425/557

(58) Field of Classification Search ..... 164/312, 164/337, 113, 900, 135; 425/557, 558
See application file for complete search history.

(56) References Cited

U.S. PATENT DOCUMENTS

| | | | | |
|---|---|---|---|---|
| 3,401,426 | A | 9/1968 | Evans | |
| 4,386,903 | A | 6/1983 | Wybenga | |
| 4,678,427 | A | 7/1987 | Fritzsche | |
| 5,785,915 | A | 7/1998 | Osuna-Diaz | |
| 5,960,854 | A | 10/1999 | Fink et al. | |
| 5,975,127 | A | 11/1999 | Dray | |
| 6,027,328 | A | 2/2000 | Herbst | |
| 6,203,311 | B1 | 3/2001 | Dray | |
| 6,230,786 | B1 * | 5/2001 | Choshi | 164/312 |
| 6,355,197 | B1 | 3/2002 | Lausenhammer et al. | |
| 6,357,511 | B1 | 3/2002 | Kestle et al. | |
| 6,533,021 | B1 * | 3/2003 | Shibata et al. | 164/312 |
| 7,284,978 | B2 * | 10/2007 | Manda et al. | 425/559 |
| 2001/0015272 | A1 | 8/2001 | Kono | |

FOREIGN PATENT DOCUMENTS

| | | | |
|---|---|---|---|
| EP | 0388242 | A2 | 9/1990 |
| WO | WO 90/09251 | A1 | 8/1990 |

* cited by examiner

*Primary Examiner*—Jonathan Johnson
*Assistant Examiner*—I.-H. Lin

(57) ABSTRACT

Disclosed herein is a metallic alloy slurry dispenser. The dispenser includes a dispensing body that defines an outlet. The dispenser also includes an outlet cover that cooperates with the outlet, and the outlet cover is configured to cooperate with the outlet more than once. The metallic alloy slurry dispenser may be used in any one of a metallic alloy slurry molding machine, a metallic alloy slurry molding assembly, a metallic alloy slurry hot runner assembly and any combination thereof.

8 Claims, 8 Drawing Sheets

METALLIC ALLOY SLURRY DISPENSER

FIELD OF THE INVENTION

The present invention generally relates to metallic alloy molding machines and/or associated assemblies, and more specifically the present invention relates to a metallic alloy slurry dispenser for use with any one of a metallic alloy molding machine, a metallic alloy hot runner assembly, a metallic alloy molding assembly, and any combination thereof.

BACKGROUND

Known metallic alloy slurry molding machines and associated assemblies may be used to mold a metallic alloy slurry such as, for example (but limited to) a slurry of magnesium, aluminum, and zinc, and any combination thereof, or equivalent thereof. The industry in general may refer to the metallic alloy slurry molding machine as a thixo-molding machine.

A first type of metallic material may exist in any one of two possible states: a liquefied state or a solidified state. The temperature at which the first type of metal material may change between the liquefied state and the solid state may be called the "melt" temperature. As a rule of thumb, the first type of metallic material may be a pure metal having substantially no impurities therein. For example, a cast molding or a die molding process and machinery may be used to mold the first type of metallic material by placing the first type of metallic material existing in the liquefied state into a mold assembly, cooling the mold assembly, and then removing the solidified first type of metallic material from the mold assembly, In sharp contrast to the first type of metallic material, a second type of metallic material may exist in one of three possible states: the liquefied state, the solidified state and a slurry state. The temperature at which the second type of metallic material changes between the liquefied state and the slurry state may be called the liquefied-slurry change temperature. The temperature at which the second type of metallic material changes between the slurry state and the solidified state may be called the slurry-solid change temperature. The slurry-solid change temperature is less than the liquefied-slurry change temperature. The slurry temperature range is temperature between the slurry-solid change temperature and the liquefied-slurry change temperature. The second type of metallic material existing in the slurry state is a combination of the second type of metallic material in the liquefied state and the second type of metallic material in the solidified state. An approximate visual analogy of the second type of metallic material may be a cup of hot water containing peas therein.

As a rule of thumb, the second type of metallic material is a metallic alloy that contains two or more metallic elements and/or nonmetallic elements usually fused together or dissolved into each other. For example, a thixo-molding process and machinery may be used to mold the second type of metallic material by placing the second type of metallic material existing in the slurry state into a mold assembly, cooling the mold assembly, and then removing the solidified second type of metallic material from the mold assembly. The advantage of using the second type of metallic material in the slurry state is that the strength of the molded article is inversely proportional to the temperature of the slurry, in that the cooler the slurry temperature, the stronger the resulting molded article will be. The reasons for the inversely proportional strength phenomena are known. Also, shrinkage of the molded article is less likely to occur when using MAS having a lower temperature in the slurry temperature range, in which the reduced shrinkage factor may improve part integrity and strength.

Henceforth, the second type of metallic material existing in the slurry state within the slurry temperature range will be referred to as "a metallic alloy slurry". The metallic alloy slurry exists in the slurry state includes a liquid component and a solid component. The industry also may refer to the metallic alloy slurry as "a thixotropic metallic material", and the molding machine that handles the thixotropic metallic material is called a thixo-molding machine.

The thixo-molding machine may outwardly appear to resemble a plastic resin injection molding machine. However, there are many internal differences between these two types of molding machines. The thixo-molding machine receives, at room temperature, a collection of chipped metallic alloy (such as an alloy of magnesium) into a hopper mounted on top of the thixo-molding machine. The chips, which exist in a solid state, are then volumetrically loaded into a smaller hopper that is mounted directly to a barrel. A rotating screw mounted in the barrel is then used to meter the chips along a length of the barrel. The screw rotation produces a shearing action which means that the screw mixes and/or tears the chips. The barrel includes heaters which apply heat to the chips as they are mixed and/or sheared by the screw. The chips are then transformed from the solidified state into the metallic alloy slurry (MAS). The MAS is then forced past a shut-off valve and then injected into a cavity defined by a mold assembly. Once the MAS becomes solidified in the mold assembly, the solidified MAS is removed and trimmed. Generally, several advantages are realized when thixo molding is used, such as: greater process control, increased part-to-part consistency; lower porosity; ability to mold complex features; better surface finish; net shape parts; thin wall molding; and reducing/eliminating a the need for secondary operations.

Sometimes the shut-off valve may be called a nozzle or a dispenser. Generally, the shut-off valve defines a supply passageway therein for conveying the MAS. The shut-off valve has a tip which defines an opening. The opening communicates the MAS into the cavity defined by the mold assembly. Controlling the flow (that is: either preventing the flow when not desired and permitting the flow when desired) of the MAS is achieved by locally cooling the MAS that is located near or at the opening of the valve so that the localized MAS may be transformed from the slurry state into the solidified state. The localized solidified MAS forms what is commonly known as a "thixo plug". During a shot build up cycle and with the thixo plug in place in the valve opening, the thixo-molding machine builds up a shot of MAS (that is MAS in the slurry state) behind the solidified thixo plug. The built-up shot of MAS remains under a shot build-up pressure. During an injection cycle, the thixo-molding machine increases the internal pressure of the MAS higher than the shot build-up pressure. The higher built-up pressure (the pressure within the barrel and the valve) is known as a "plug blow out" pressure. The plug blow out pressure is high enough to blow the thixo plug out from the valve opening and into the mold cavity, followed by free flow the MAS (existing in the slurry state) from the passageway of the valve. Once the mold cavity is filled, the thixo plug may be reformed in the valve opening by a cooling effect induced by a cooling structure located nearby the valve opening.

However, the thixo plug may impose an operator safety hazard if the mold assembly is not in position to receive a blown out thixo plug from the dispenser. The MAS (in slurry state) may splatter and splash over unsuspecting operators of the thixo-molding machine. Avoiding this hazard requires a very consistent thixo plug (in solid state) or a very good control and management of local thermal condition in the area where the thixo plug is formed so that any excess pressure in the melt channel will not accidentally expel or blow out the thixo plug when the mold assembly is opened. Should the thixo plug suddenly become molten when the mold is open (as a result of intermittently operating localized cooling effects), the MAS in slurry state may be uncontrollably discharged from the dispenser and onto operators of the thixo-molding machine.

U.S. Pat. Nos. 5,785,915, 6,355,197, 5,975,127, 6,027,328, 3,401,426 and 4,386,903 all disclose molten plastic resin dispensers used with a resin plastic molding machine; however, these patents do not teach, suggest or motivate the industry to use molten plastic resin dispensers for dispensing the MAS. The reason for this may be that there are material attribute or material characteristic differences between the MAS and the plastic resin, and those differences may hamper or discourage the deployment of plastic resin dispensers in a thixo-molding machine. For example, such differences between the MAS and the plastic resin are (but not limited to):

- the melting point of the MAS may range from 400° C. to 700° C. which is substantially higher than that of plastic resin;
- the thermal conductivity of MAS is much higher than that of plastic resin;
- the compressibility of MAS is significantly less than that of plastic resin;
- the corrosiveness and/or abrasiveness of MAS (while solidified as a thixo plug for example) is much higher than that of molten plastic resin;
- high fluidity and low viscosity of MAS (relative to the molten plastic resin) cause the MAS to travel through much smaller gaps that may exist between structural components of the thixo-molding machine; and
- spontaneous explosive reactivity of some types of MAS; for example, exposing magnesium to air will cause magnesium to burn explosively. In sharp contrast, plastic resin does not spontaneously combust when exposed to air.

As can be appreciated from the foregoing list of material differences, while known plastic-resin compatible molding-machine valves work satisfactorily with plastic resin, they raise technical concerns when these types of valve are proposed for use with the thixo-molding machine. These raised concerns have presently shaped conventional wisdom which calls for avoiding the combination of known plastic resin dispensers with thixo-molding machines because the MAS imposes technological difficulties and uncertainties that may adversely affect the resin plastic dispenser used in a thixo-molding machine.

By way of example that shows the conventional wisdom pertaining to current thixo molding technology, U.S. Pat. No. 6,533,021 ('021) discloses a MAS dispenser, in which a mold for a metal hot-runner injection molding machine includes a movable mold plate, a fixed mold plate having a nozzle for injecting molten metal into said cavity, and a heating device disposed outside the nozzle for heating metal. A gate cut portion is situated in the nozzle between the heating device and the tip. A temperature measurement device is arranged adjacent to the gate cut portion for measuring the temperature of the metal in the gate cut portion. A heating control device is connected to the heating device for controlling a temperature of the nozzle based on the temperature measurement device. A heat insulation device is arranged on the nozzle to cover at least an area where the gate cut portion is formed. The '021 patent discloses a nozzle that operates by forming and melting a thixo plug. FIG. 8 shows the nozzle operating with a pin 41 in which the pin 41 forces a thixo plug back into a melt channel 11 where the thixo plug is re-melted to become part of the melt. It is interesting to note that the thixo plug is formed and used only once as a plug mechanism, and then for the next injection cycle, an entirely new thixo plug is formed and used. In other methods, the thixo plug is expelled from the channel by melt pressure and trapped in a thixo plug catcher. These methods may have problems. If the thixo plug reenters the melt channel, it may not fully melt before injection and thereby inconsistencies in the molded product may be experienced. Discharging the thixo plug from the channel can be a safety hazard if the thixo plug is inadvertently discharged when the mold is open. Also, the pressure required to discharge the thixo plug may vary from shot to shot and timing of the opening of the melt channel is difficult to predict. This can be a serious concern when making multiple drops into the mold assembly.

U.S. Pat. No. 6,357,511 discloses a thixo feed body (called a sprue bushing) which does not appear to teach a thixo dispenser, and appears to teach overcoming leaky spure connections.

Therefore, a solution is desired which addresses, at least in part, the above-mentioned and other potential shortcomings.

SUMMARY

According to an aspect of the present invention, there is provided, for any one of a metallic alloy slurry molding machine, a metallic alloy slurry molding assembly, a metallic alloy slurry hot runner assembly and any combination thereof, a metallic alloy slurry dispenser, including a dispensing body defining an outlet, and an outlet cover cooperating with the outlet, wherein the outlet cover is configured to cooperate with the outlet more than once.

According to another aspect of the present invention, there is provided a metallic alloy slurry molding machine, including a base, a barrel cooperating with the base, any one of a metallic alloy slurry molding assembly, a metallic alloy slurry hot runner assembly and any combination thereof cooperating with the base, and a metallic alloy slurry dispenser cooperating with any one of the barrel, the metallic alloy slurry molding assembly, the metallic alloy slurry hot runner assembly and any combination thereof, including a dispensing body defining an outlet, and an outlet cover cooperating with the outlet, wherein the outlet cover is configured to cooperate with the outlet more than once.

According to yet another aspect of the present invention, there is provided a metallic alloy slurry molding assembly, including a mold body defining a mold passageway therein, and a metallic alloy slurry dispenser cooperating with any one of the first mold portion and the second mold portion, including a dispensing body defining an outlet, and an outlet cover cooperating with the outlet, wherein the outlet cover is configured to cooperate with the outlet more than once.

According to yet another aspect of the present invention, there is provided a metallic alloy slurry hot runner assembly, including a hot runner body defining a hot runner passageway therein, and a metallic alloy slurry dispenser cooperating with the hot runner passageway, including a dispensing body defining an outlet, and an outlet cover cooperating with the outlet, wherein the outlet cover is configured to cooperate with the outlet more than once.

BRIEF DESCRIPTION OF THE DRAWINGS

A better understanding of the embodiments may be obtained with reference to the following drawings and detailed description of the embodiments, in which.

Similar references are used in different figures to denote similar components.

DETAILED DESCRIPTION OF THE EMBODIMENTS

Figure 1:
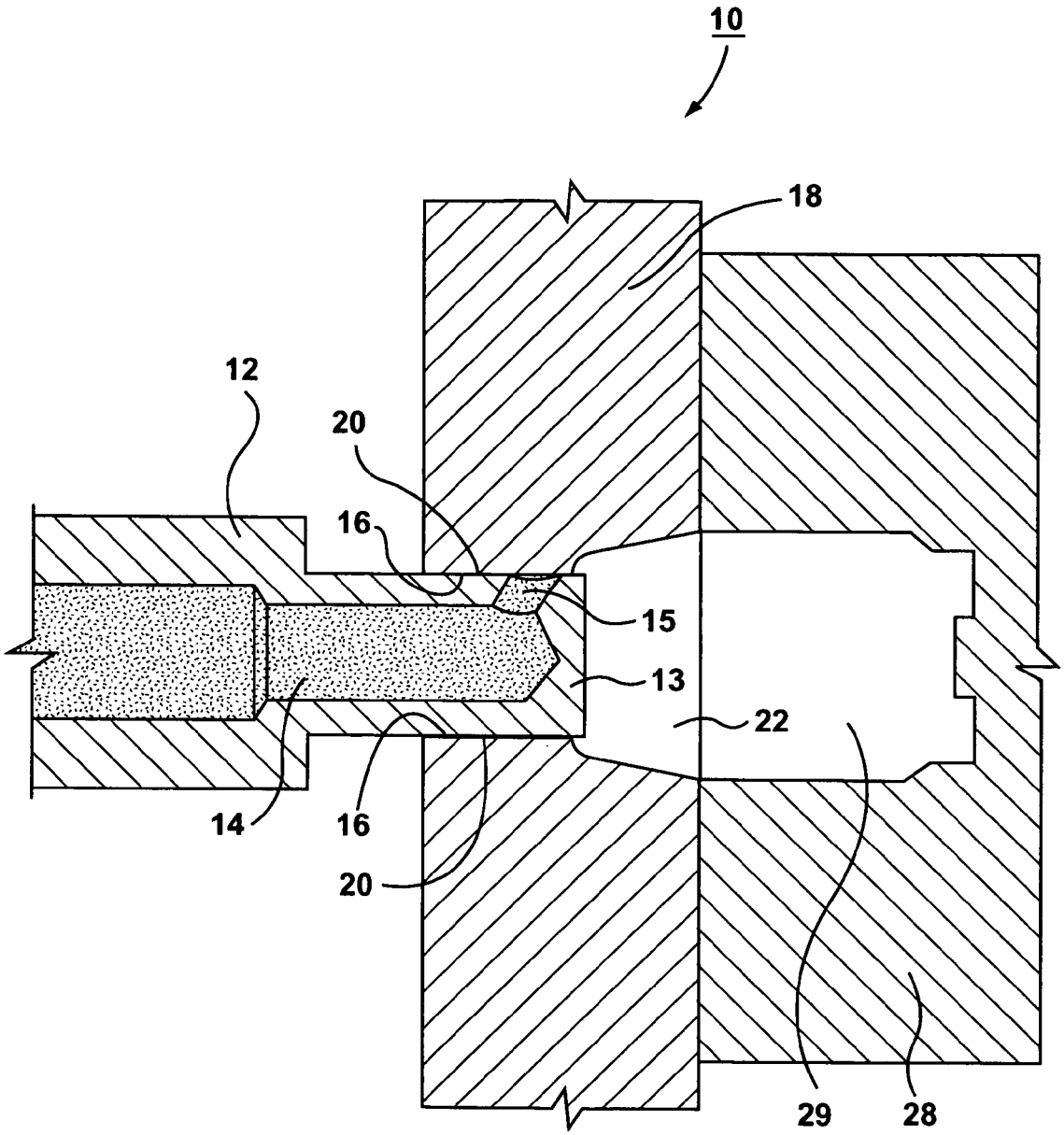
FIG. 1 is a cut away view of a metallic alloy slurry dispenser (MASD) in a flow disabled position according to a first embodiment.
Figure 2:
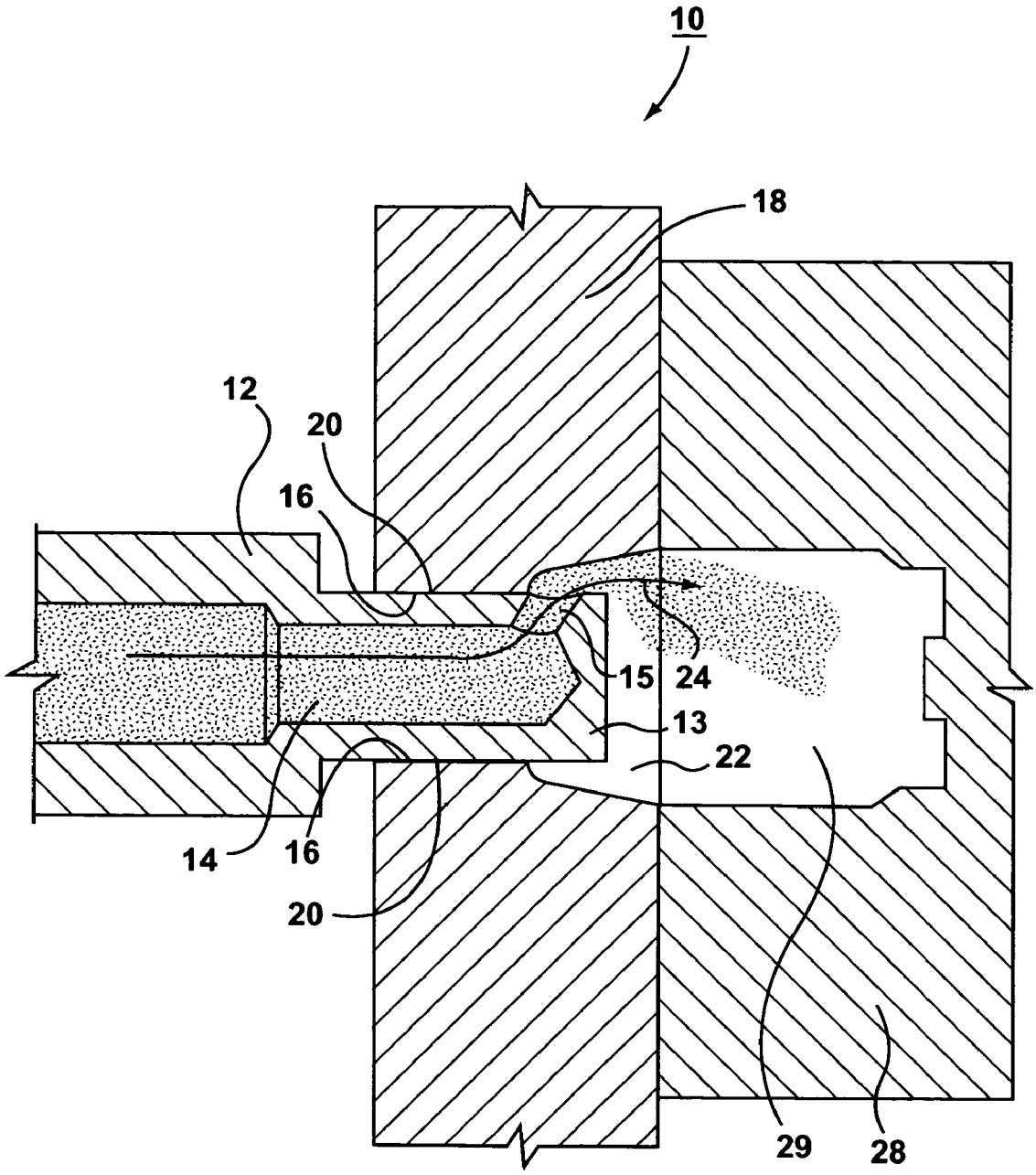
FIG. 2 is the cut away view of the MASD of FIG. 1 in a flow enabled position.

FIG. 1 is a cut away view of a MASD 10 according to the first embodiment in a flow disabled position. The MASD 10 includes a dispensing body 12 that presents a tip 13 (or distal end) that defines an outlet 15 therein. The outlet 15 may also be called an exit port. The dispensing body 12 may also be called a nozzle, a nozzle body or a valve and will hereinafter be referred to as the nozzle body 12 for sake of simplifying the description. The nozzle body 12 also defines a passageway 14 therein which is connected to the outlet 15. The MASD 10 also includes an outlet cover 18. The outlet cover 18 in FIG. 1 also acts as a stationary mold half of a mold assembly, but it will be called the outlet cover 18 for the description directed to FIGS. 1 and 2. A moving mold half 28 mates with the stationary mold half (which is depicted as the outlet cover 18), and defines a mold cavity 29 therein. In operation, the outlet 15 and the outlet cover 18 repeatably cooperate with each other. For example, the outlet 15 and the outlet cover 18 are operatively movable relative to each other between the flow disabled position (which is depicted in FIG. 1) and a flow enabled position (which is depicted in FIG. 2). "Repeatably" means to that the outlet cover 18 and the outlet 15 repeatably cooperate with each other more than once. In sharp contrast, the thixo plug does not repeatably cooperate with an outlet since the thixo plug is a single use item that covers the outlet once only and then is never used again (the thixo plug becomes blown out into a mold cavity), and an entirely new thixo plug is formed for the next dispensing of MAS into the mold cavity. In summary, the dispensing body 12 defines the outlet 15 therein; and the outlet cover 18 cooperates with the outlet 15, wherein the outlet cover 18 is configured to cooperate with the outlet 15 more than once.

In the flow disabled position, the outlet cover 18 covers the outlet 15, and the covered outlet 15, in turn, substantially blocks any flow of MAS contained behind the covered outlet 15 and within the passageway 14. As will be shown in FIG. 2, in the flow enabled position, the nozzle body 12 is moved relative to the outlet cover 18 (that is, the stationary mold half) and then the outlet 15 becomes uncovered, in which the uncovered outlet 15, in turn, permits unrestricted flow of MAS into the mold cavity 29.

By using the MASD 10, formation of the frozen thixo plug in the outlet 15 may be avoided if there is sufficient heat energy to maintain the MAS in the slurry state. The required heating effect may be provided by a heater coupled to the nozzle body 12 or other another heater located adjacently to the outlet 15 as required.

Advantageously, the outlet cover 18 may substantially prevent accidental (that is, premature or inadvertent) release of MAS from the outlet 15 because the cover 18 so disposed over the outlet 15 substantially prevents flow or movement of the MAS from the outlet 15, and also may help reduce the likelihood of reduced thixo-molding machine productivity and/or reduce the likelihood of accidental burning of and injury to operators.

The MASD 10 may help to avoid adverse changes in dynamics of a screw mechanism disposed in the barrel of the thixo-molding machine (not depicted but connected to the MASD 10). By avoiding the formation of the thixo plug, the pressure variations in the barrel may be moderated. When the pressure in the barrel becomes moderated, the fill time for filling the mold cavity 29 may be more consistent when molding parts in the cavity 29.

Usage of the thixo plug requires the barrel and screw mechanism of the thixo-molding machine to impose a larger range on the MAS. If the pressure in the barrel is too large, a mold flash phenomena occurs in the mold assembly defining the cavity 29, in which the flowing MAS may be forced too quickly into the cavity 29 and then MAS may flash out (or leak) from between the mold portions of the mold assembly. This condition may lead to a defective molded part or a weaker molded part in that the MAS was not given the opportunity to complete pack into the cavity 29 as a result of the leak or flash of MAS. Also, if the pressure in the barrel is too low, a freezing phenomena may occur in the cavity 29, in which the MAS may not move far or fast enough into the cavity 29, and then the slow moving MAS may prematurely freeze and block flowing MAS from completely filling the cavity 29. By avoiding the use of the thixo blow pressure, the pressure in the barrel may be moderated and thereby avoid the flashing and freezing phenomena described above.

The outlet cover 18 is depicted as the stationary mold. But it will be appreciated that the outlet cover may also be other structures conveniently located adjacent to the outlet 15, such as for example: a mold gate insert, a mold assembly, a hot runner insert, or a hot runner assembly. The outlet cover 18 presents an outlet cover surface 20 which is used to cover and uncover the outlet 15 as required. For the first embodiment, the outlet cover surface 20 faces the outlet 15 and slides coaxially with the nozzle body 12. Other arrangements may be considered for the outlet cover 18, such as disposing a valve stem (not depicted) within the passageway 14 and the stem moves into contact with the outlet 15 which seals the outlet 15 to disable flow of the MAS from the covered outlet 15.

The outlet cover 18 defines a passageway 22 which receives the nozzle body 12 therein. The body 12 may present a seat member 16 which faces the outlet cover surface 20 and slides coaxially with respect to the outlet cover surface 20.

The MASD 10 may include a thermal energy differential mechanism (not depicted) that may be a combination of heating and cooling devices that maintain a temperature difference in a localized basis. In the flow disabled position, heat may be removed from the outlet 15 sufficient enough to permit solidification of the MAS in the outlet 15 if so desired. This cooling effect may be achieved by using a cooling mechanism located in the outlet cover 18 and adjacent to the outlet 15. In the flow disabled position, enough heat may be provided by any one of (or in combination) the outlet cover 18 or the MAS disposed in the passageway 14. The provided heat is sufficient for maintaining the MAS substantially in the slurry state while the MAS is disposed in the outlet 15 and the passageway 14. Advantageously, by maintaining the MAS in the slurry state, the formation of the frozen thixo plug may be avoided.

The thermal energy differential mechanism may include predetermined shapes of structure surrounding the outlet 15. The predetermined shapes of structure may set up and maintain the heating effect and the cooling effect. This approach may permit a simplified and more economical structure for setting up and maintaining the heating effect and cooling effect. By using thermo-graphic modeling software, the predetermined shapes of structure surrounding the outlet 15 may be established. For example, FLIR Systems of Goleta, Calif. is a manufacturer of ThermaGRAM™ thermo-graphic modeling software which may be used to model the thermal energy differential mechanism and establish the predetermined shapes of the structure surrounding the nozzle body 12.

The MASD 10 may include an interlock assembly (not depicted) that is operatively coupled to any one of the nozzle body 12, the outlet cover 18 and the mold assembly and any suitable combination thereof. The interlock assembly prevents relative movement between the outlet 15 and the outlet cover 18 when the mold halves or portions 18 and 28 become offset or displaced from one another. The interlock assembly may, when the MAS 10 no longer cooperates with the mold assembly, operate to prevent the MASD 10 from dispensing the MAS and thereby prevent accidental release of molten material from the outlet 15 (for example: when the moving mold 28 no longer abuts the stationary mold 18).

For the first embodiment, the outlet cover 18 resides outside the nozzle body 12. The outlet cover 18 may slide or pivot relative to the outlet 15. An example of this is a rotary shut off valve. The nozzle body 12 is movable axially along its longitudinal axis which extends through the nozzle body 12. The nozzle body 12 is attached to a barrel of the thixo-molding machine, in which the barrel is actuated to reciprocate the tip 13 within the outlet cover 18 so that the nozzle body 12 slides along and within the passageway 22 defined by the outlet cover 18. However, an alternative embodiment, described below, the nozzle body 12 is stationary relative to the outlet cover 18.

The MAS 10 may be connected to the distal end of a barrel (not depicted) of a metallic alloy slurry molding machine (not depicted). The MAS 10 may be connected to a hot runner passageway defined by a metallic alloy slurry hot runner assembly (not depicted). The MAS 10 may be connected to passageway defined by a metallic alloy slurry molding assembly. It will be appreciated that the MAS 10 may be supplied separately from these assemblies.

A gap may be defined between the seat member 16 and the outlet cover 18. Specifically the gap may exist between the outlet cover surface 20 and the seat member 16. A small amount of MAS may find its way into the gap and thereby create a MAS layer. The MAS layer may be cooled during injection of the MAS into the cavity 29. Thus by cooling the MAS layer into the solidified state, the solidified MAS layer may prevent or block additional MAS from becoming pushed further into the gap while the MAS is injected (under pressure) into the cavity 29. The solidified layer of MAS may be heated during retraction of the nozzle body 12 (in which the outlet 15 becomes covered) so as to facilitate less friction while the nozzle body 12 is retracted away from the cavity 29.

FIG. 2 is the cut away view of the MASD 10 of FIG. 1 in the flow enabled position. In this position, the screw and barrel of the thixo-molding machine places an injection pressure onto the MAS. The nozzle body 12 is moved forwardly (that is, towards the mold cavity 29 placed in fluid communication with the passageway 22). In effect, the outlet cover 18 is moved relative to the outlet 15 (the outlet cover 18 remains stationary in this embodiment) so that the outlet cover 18 no longer covers the outlet 15. In this position, the uncovered outlet 15 now is in fluid communication with the passageway 22) and flow 24 of the MAS may be realized. The uncovered outlet 15 permits unrestricted flow 24 of the MAS from the outlet 15 into the cavity 29.

Figure 3:
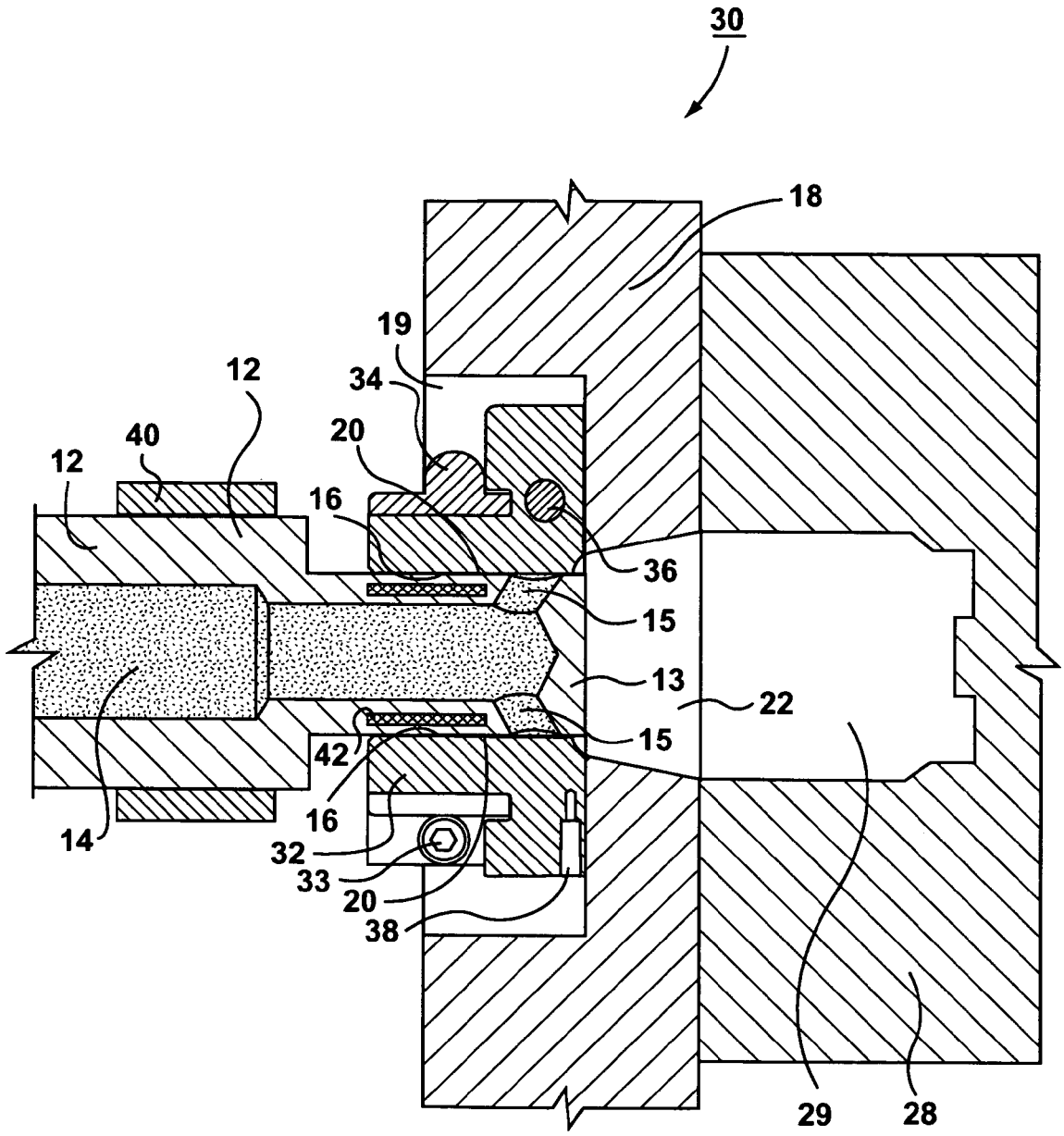
FIG. 3 is a cut away view of a MASD according to a second embodiment (which is the preferred embodiment) in a flow disabled position.

FIG. 3 is a cut away view of an MASD 30 according to the second embodiment (which is the preferred embodiment) in a flow disabled position in which preferred structures and configurations are depicted. An outlet cover 32 is used, and the stationary mold portion 18 does no longer acts at the outlet cover as was previously shown in FIGS. 1 and 2. The outlet cover 32 will be called a shut off body 32 for the preferred embodiment.

The stationary mold 18 defines a cavity 19, and the shut off body 32 is fixedly mounted to the stationary mold 18 by way of a bolt assembly (not depicted). The bolt 33 attaches a heater 34 to the shut off body 32. Mounted onto the shut off body 32 is the heater 34, a cooling apparatus 36, and a temperature sensor 38 (such as a thermocouple for example). Having the heater 34, the cooling apparatus 36, and sensor 38 installed in the shut off body 32 provides an advantage in that if maintenance service is needed on the heater 34 and/or the cooling apparatus 36 and/or the sensor 38, then the shut off body 32 may be removed and a replacement shut off body 32 may be reinserted.

The thermal energy differential (gradient) between an area behind the covered outlet 15 and the passageway 22 may be further enhanced with additional heating and cooling structural elements. An advantage for using these structures is to further enhance any required localized heating and cooling effects.

The MASD 30 may also include a nozzle heating apparatus 40 or 42 that operatively couples to the nozzle body 12. The nozzle heating apparatus 40 maintains the MAS contained within the outlet 15 in the slurry state.

The MASD 30 may also include the outlet cover heating apparatus 34 that operatively couples to the shut off body 32. The apparatus 34 substantially maintains the MAS disposed in the outlet 15 in the slurry state while it remains in the outlet 15 while the MASD 30 remains in the flow disabled position.

The MASD 30 may also include an outlet cover cooling apparatus 36 which operatively couples to the shut off body 32 or any structures in close proximity to the outlet 15. The apparatus 36 defines or provides a conduit which conveys a cooling fluid therein. The apparatus 36 cools the MAS disposed between a gap defined between the shut off body 32 and the nozzle body 12 into a solidified state. This configuration may provide improved cooling effect so that in the flow enabled position, any solidified MAS located within the gap may be used to substantially prevent flow of MAS from the passageway 22 back into the gap. The gap is defined between the shut off body 32 and the nozzle body 12.

The heating effect may be kept relatively constant while the cooling effect may be varied because varying or changing the amount of heat may prove to be more difficult in comparison with changing the amount of cooling.

Figure 4:
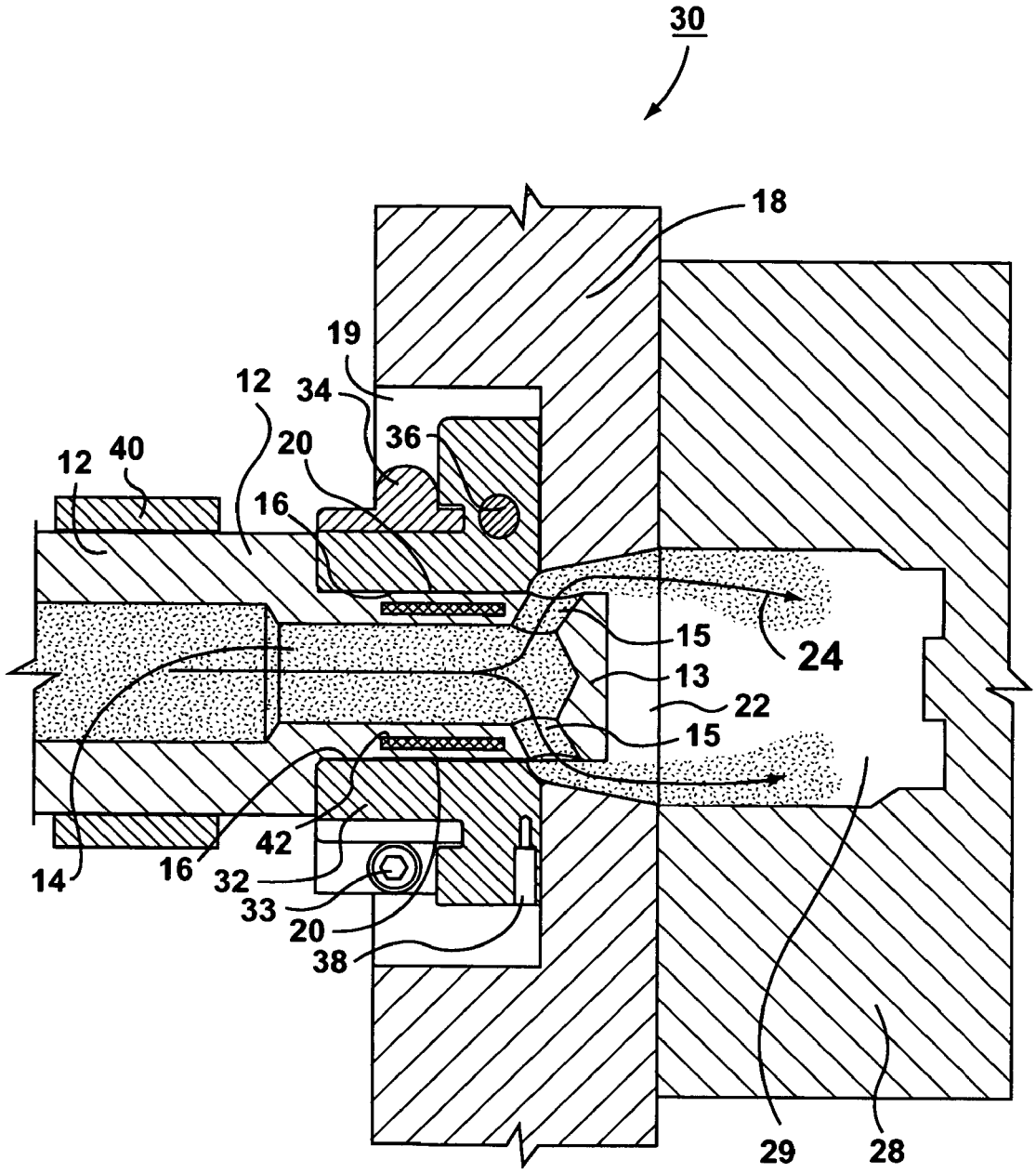
FIG. 4 is the cut away view of the MASD of FIG. 3 in a flow enabled position.

FIG. 4 is the cut away view of the MASD 30 of FIG. 3 in a flow enabled position. In this position, the nozzle body 12 was moved or displaced by the barrel of the thixo-molding machine such that the outlet 15 is no longer covered by the shut off body 32 and as a result, the MAS may flow 24 from the uncovered outlet 15.

Figure 5:
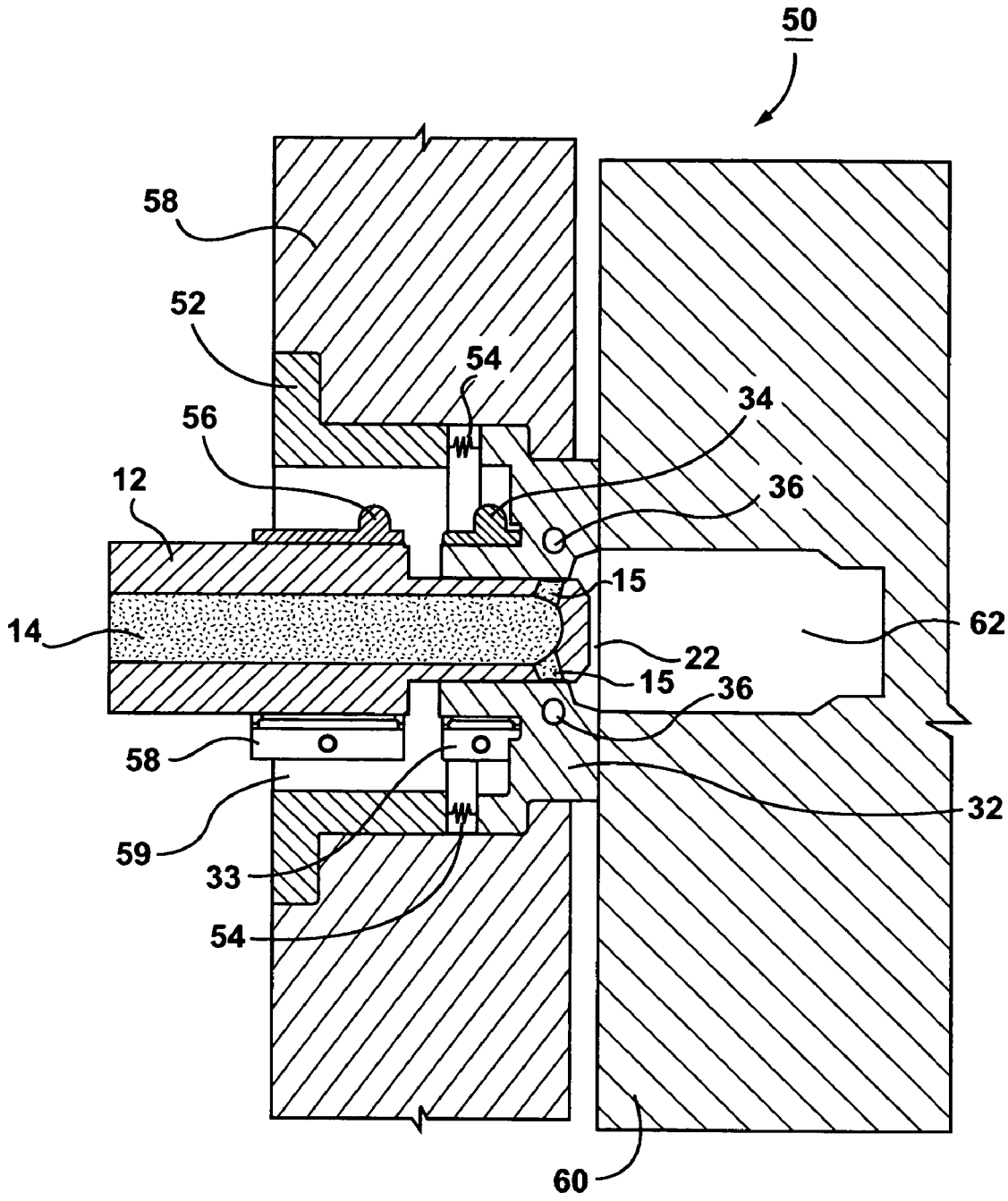
FIG. 5 is a cut away view of a MASD according to a third embodiment in a flow disabled position.

FIG. 5 is a cut away view of an MASD 50 according to the third embodiment in a flow disabled position. In this position, the shut off body 32 acts at the outlet cover. The shut off body 32 is made to be moved while the nozzle body 12 is made to be stationary. While the third embodiment may be used in a hot runner manifold assembly, FIG. 5 depicts the third embodiment instilled in a stationary mold 58, and the hot runner assembly (while not depicted) is connected to the nozzle body 12.

The MASD 50 includes a stop 52 which is formed to fit within a cavity 59 defined by the stationary mold 58. A spring 54 is disposed between the stop 52 and the shut off body 32.

In the flow disabled position, the moving side of the mold 60 is made to move by way of an actuated mold clamp (not depicted) and thereby the mold moving side 60 becomes offset from the stationary mold 58, and also becomes offset or removed from the shut off body 32. In response to the movement of the mold assembly 60 moving away from the shut off body 32, the spring 54 urges the shut off body 32 to move towards the removed mold portion 60. A portion of the moved shut off body 32 now covers the outlet 15, and the covered outlet 15 disables or blocks flow of the MAS disposed within the passageway 14. Generally, in the flow disabled position, the shut off body 32 moves in response to movement of the moving mold portion 60 moving away from the stationary mold 58 so that the moved shut off body 32 covers the outlet 15. A heater 56 may be installed on the nozzle body 12 while another heater 34 may be installed on the shut off body 32. The shut off body 32 presents an outlet cover surface which interacts with the outlet 15.

Figure 6:
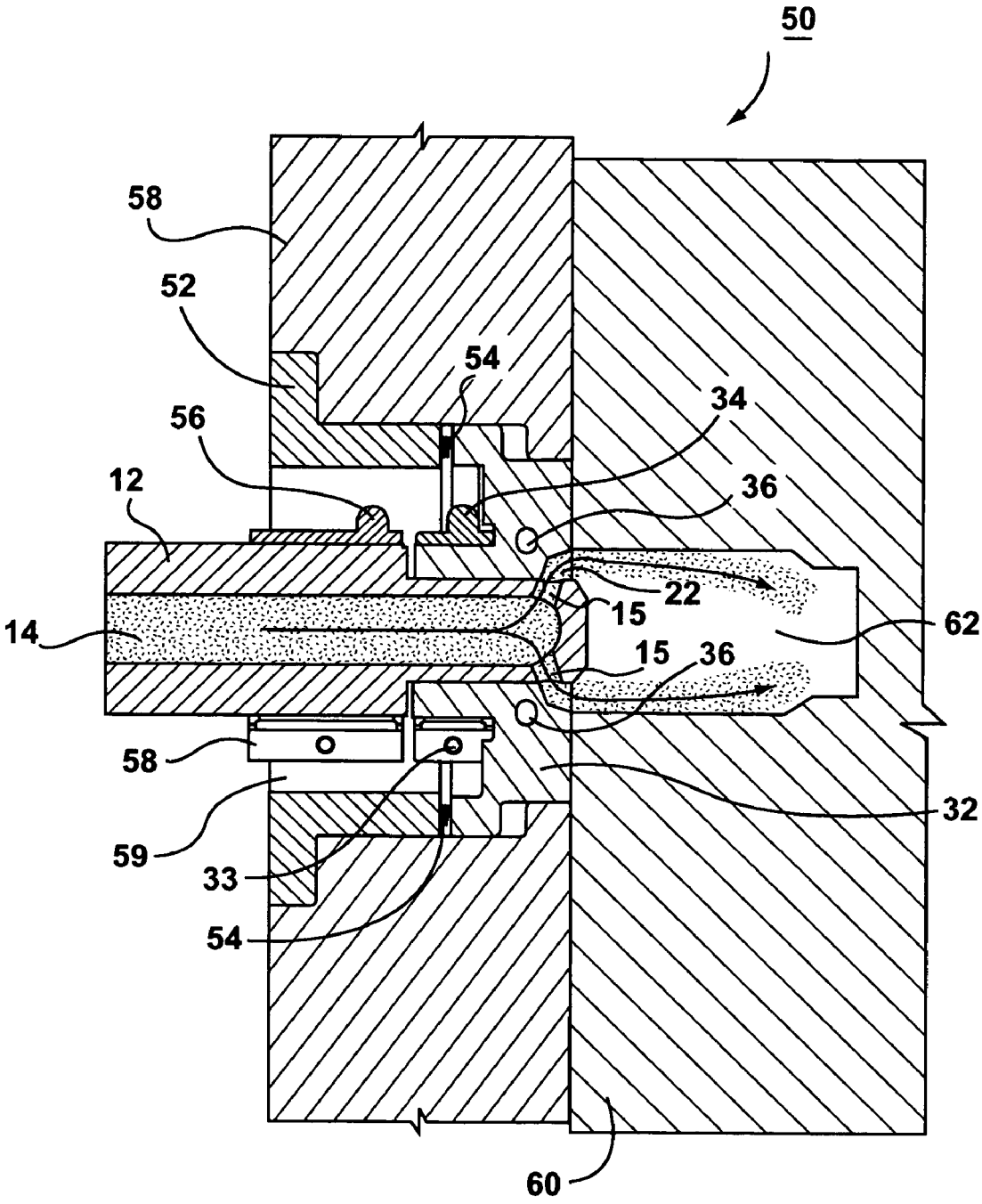
FIG. 6 is the cut away view of the MASD of FIG. 5 in a flow enabled position

FIG. 6 is the cut away view of the MASD 50 of FIG. 5 in a flow enabled position. Generally, in the flow enabled position, the shut off body 32 moves in response to the mold half 60 moving and abutting against the shut off body 32. The moved shut off body 32 becomes offset from the outlet 15 so that the MAS may flow 24 from the uncovered outlet 15. Specifically, the moving mold 60 is made to move and push against the shut off body 32, and in turn the shut off body 32 is displaced towards the stop 52 (and the spring 54 becomes depressed). A mold cavity 62 becomes lined up with the passageway 22 of the shut-off body 32. In response to the shut off body 32 moving towards the stop 52, the shut off body no longer covers the outlet 15 and the MAS contained within the outlet 15 may flow 24 freely without restriction.

Figure 7:
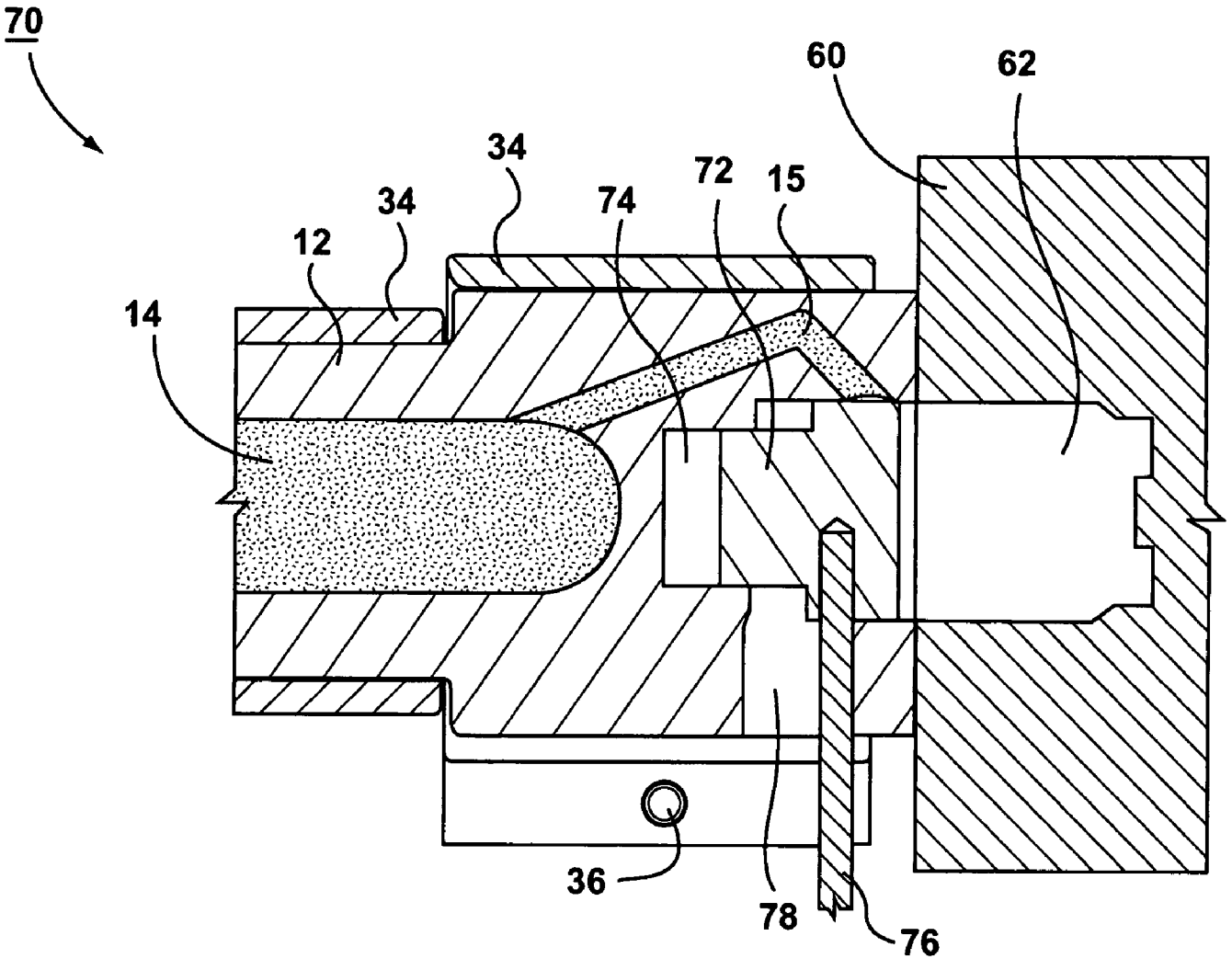
FIG. 7 shows is a cut away view of a MASD according to a fourth embodiment in a flow disabled position.

FIG. 7 shows is a cut away view of a MASD 70 according to the fourth embodiment in a flow disabled position. The MASD 70 includes an outlet cover which is indicated as a shut off body 72 which can also be called a stem. The nozzle body 12 defines a cavity 74 therein for slidably receiving the shut off body 72 therein. The shut off body 72 is slidable within the cavity 72 so as to alternately cover and uncover the outlet 15. The nozzle body 12 also defines another passageway 78 that extends from the passageway 74 towards the outer edge of the nozzle body 12. Disposed within the passageway 78 is a retaining rod 76 which connects to the shut off body 72. The retaining rod 76 is externally actuated by mechanisms which are not depicted. For example, while one end of the retaining rod 76 is connected to the shut off body 72, the other end (not depicted) of the retaining rod 76 may be attached to a hydraulic, a pneumatic, an electric or a mechanic actuation assembly. The rod 76, when actuated, may move the shut off body 72 between a outlet closed and an outlet opened position. In this manner, the actuation of the shut off body 72 is not made dependent directly on the operation of the mold assembly, but may be indirectly dependent on the operation of the mold assembly by way of the actuation mechanisms acting as an intermediary actuations structure. The mold assembly may operate directly on the actuations mechanisms which in turn actuate the rod 76.

Figure 8:
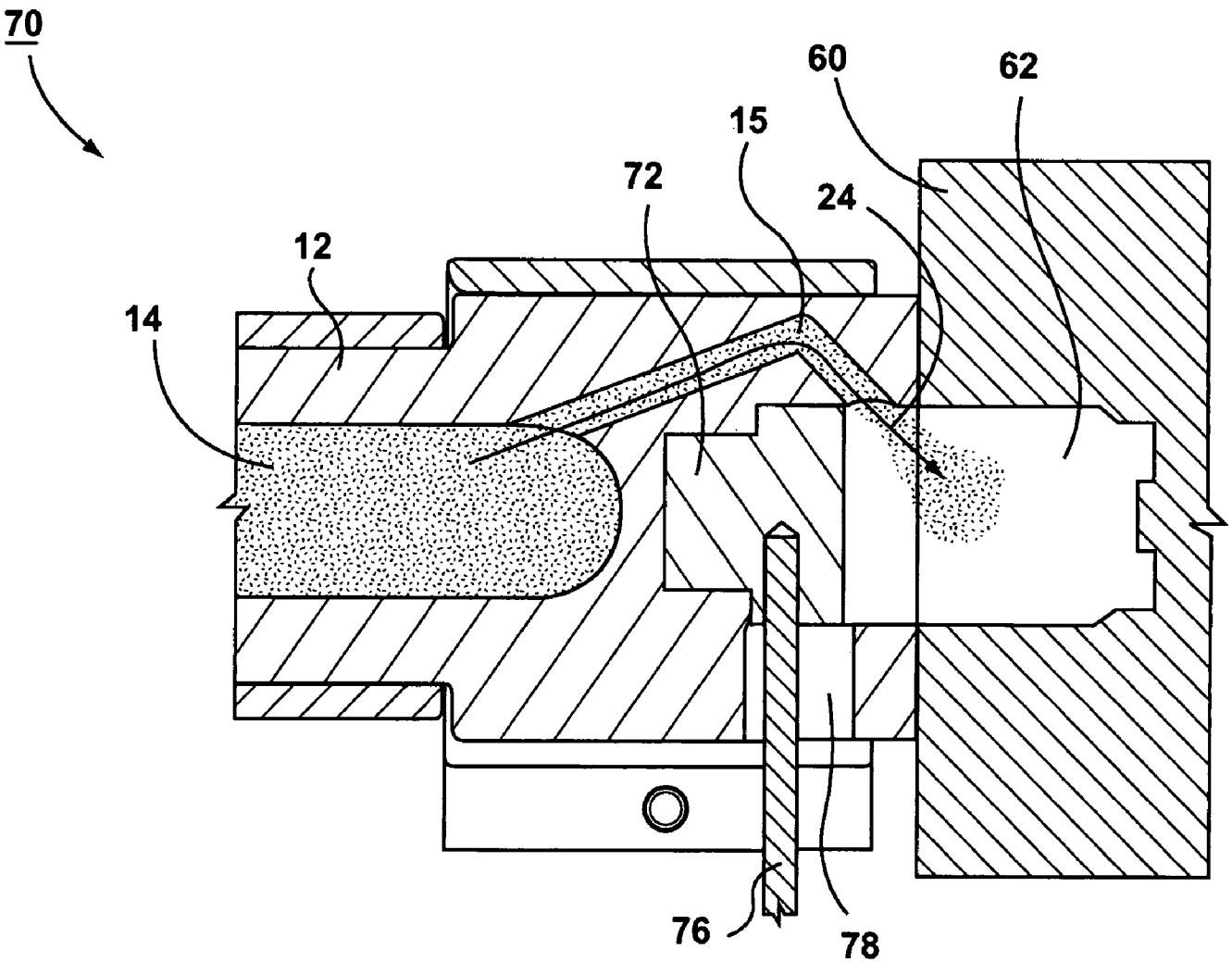
FIG. 8 is the cut away view of the MASD of FIG. 7 in a flow enabled position.

FIG. 8 is the cut away view of the MASD of FIG. 7 in a flow enabled position, in which the shut off body 72 is retracted (by way of the rod 76) away from the outlet 15 so as to uncover the outlet 15.

It will be appreciated that some elements may be adapted for specific conditions or functions. The concepts described above may be further extended to a variety of other applications that are clearly within the scope of the present invention. Having thus described the embodiments, it will be apparent to those skilled in the art that modifications and enhancements are possible without departing from the concepts as described. Therefore, what is intended to be protected by way of letters patent should be limited only by the scope of the following claims:

The invention claimed is:

1. For any one of a metallic alloy slurry molding machine, a metallic alloy slurry molding assembly, a metallic alloy slurry hot runner assembly and any combination thereof, a metallic alloy slurry dispenser, comprising:

a dispensing body defining an outlet; and an outlet cover cooperating with the outlet, wherein the outlet cover is configured to cooperate with the outlet more than once, the outlet cover being movable relative to the outlet between a flow disabled position and a flow enabled position, so that: (i) in the flow disabled position, the outlet cover covers the outlet to block any flow of metallic alloy slurry held behind the covered outlet, and (ii) in the flow enabled position, the outlet cover uncovers the outlet to permit a flow of metallic alloy slurry from the covered outlet;

a dispensing body heating apparatus operatively coupled to the dispensing body, and maintaining, in use, a molten metallic alloy slurry being contained within the outlet in a substantially molten condition;

an outlet cover heating apparatus operatively coupling the outlet cover, and maintaining, in use, a thixotropic material disposed in the outlet in a molten state while the thixotropic material remains in the outlet in the flow disabled position; and an outlet cover cooling apparatus operatively coupling the outlet cover, and cooling, in use, a molten metallic alloy slurry disposed between a gap defined between the outlet cover and the dispending body into a solidified state.

2. The metallic alloy slurry dispenser of claim 1, wherein:

in the flow disabled position, heat removed from components adjacent the outlet and outside of the outlet is sufficiently enough to permit solidification of a metallic alloy slurry in the gap between the outlet cover and the dispensing body;

in the flow enabled position, the outlet cover is movable in response to movement of a mold assembly abutting the outlet cover, the outlet cover becoming offset from the outlet once the outlet cover is moved to do so; and in the flow disabled position, the outlet cover is movable in response to movement of the mold assembly becoming offset from the outlet cover, the outlet cover covering the outlet once the outlet cover is moved to do so.

3. The metallic alloy slurry dispenser of claim 1, wherein:

in the flow disabled position, heat removed from components adjacent the outlet and outside of the outlet is sufficiently enough to permit solidification of a metallic alloy slurry in the gap between the outlet cover and the dispensing body.

4. The metallic alloy slurry dispenser of claim 1, wherein:

in the flow enabled position, the outlet cover is movable in response to movement of a mold assembly abutting the outlet cover, the outlet cover becoming offset from the outlet once the outlet cover is moved to do so.

5. The metallic alloy slurry dispenser of claim 1, wherein:

in the flow disabled position, the outlet cover is movable in response to movement of a mold assembly becoming offset from the outlet cover, the moved outlet cover covering the outlet once the outlet cover is moved to do so.

6. The metallic alloy slurry dispenser of claim 1, wherein:

the outlet cover resides outside the dispensing body.

7. The metallic alloy slurry dispenser of claim 1, wherein:

the outlet cover is slidably movable relative to the outlet.

8. The metallic alloy slurry dispenser of claim 1 wherein:

the dispensing body includes an axis extending therethrough; and the outlet is aligned substantially parallel to the axis.

* * * * *